US006899331B1

(12) United States Patent
Beyazbayrak

(10) Patent No.: US 6,899,331 B1
(45) Date of Patent: May 31, 2005

(54) CONSTRUCTION TOY AMERICAN FOOTBALL GAME

(75) Inventor: Ali Beyazbayrak, Trawden (GB)

(73) Assignee: Best-Lock Construction Toys, Inc., Miami, FL (US)

( * ) Notice: Subject to any disclaimer, the term of this patent is extended or adjusted under 35 U.S.C. 154(b) by 41 days.

(21) Appl. No.: 10/281,018

(22) Filed: Oct. 25, 2002

Related U.S. Application Data

(60) Provisional application No. 60/336,543, filed on Oct. 25, 2001.

(51) Int. Cl.[7] ..... A63F 3/00
(52) U.S. Cl. ..... 273/239; 273/247
(58) Field of Search ..... 273/239, 247, 273/259, 277, 287; D21/357; 434/128

(56) References Cited

U.S. PATENT DOCUMENTS

| | | | | |
|---|---|---|---|---|
| 593,512 | A * | 11/1897 | Hahalane | 273/247 |
| 1,145,955 | A * | 7/1915 | Wittstein | 273/317.5 |
| 1,954,838 | A * | 4/1934 | Woolsey et al. | 273/317.5 |
| 3,091,459 | A * | 5/1963 | Lindman | 273/108.4 |

* cited by examiner

*Primary Examiner*—Vishu K. Mendiratta
(74) *Attorney, Agent, or Firm*—Alberto A. Leon, Esquire; Bauman, Dow & Leon, P.C.

(57) ABSTRACT

The invention disclosed herein generally concerns a construction toy American Football board-type game arrangement assembled using construction toy bricks and played using a series of rules based on conventional American Football. The game of the invention comprises construction toy bricks and pieces of numerous colors and sizes which allows the user(s) of the invention to assemble a miniature American Football stadium in a plurality of dimensions and field color combinations. The playing surface is designed to allow placement of construction toy pieces such as bases, figures and goal posts. A stadium structure built according to an instruction manual and comprises bleachers, a sky box, an announcer's box and a score box can be placed adjacent to the game board. The invention disclosed herein further comprises player figures that can be engaged to a construction toy base and place on the field emblazoned on the game board to form offensive and defensive lines, certain players being able to advance a play football across the playing field via a throwing means comprising a mechanically propelled arm (spring, coil, etc.), while other players being able to score "field goals" via a kicking means comprising a mechanically propelled leg (spring, coil, etc.). Further, certain players designated as receivers and defenders have a catching means in order to catch the magnetized football. The receiving means can be a fitted to the receiver and defender figures or can be a removable shoulder protection pack comprising a catching means such as a magnetic metal piece. Conversely, the playing ball is equipped with means to attach itself to the receiving means, such as a magnetic metal core covered with an appropriate magnetic conducting material. The game of this invention is played using conventional American Football rules and a special dice is provided to control certain game actions.

9 Claims, 12 Drawing Sheets

CONSTRUCTION TOY AMERICAN FOOTBALL GAME

CROSS-REFERENCE TO RELATED APPLICATION

I hereby claim the benefit under Title 35, United States Code Section 119(e) of any United States Provisional Application(s) listed below:
Application No. 60/336,543
Filing Date: Oct. 25, 2001.

BACKGROUND OF THE INVENTION

1. Technical Field of the Invention

This invention generally relates to construction toys, construction toy bricks, construction toy blocks, construction toy games, board games, sport board games and American Football board games.

2. Description of the Background Art

According to various history sources, games predate written history and are considered a vital part of humans' social evolution. The competition inherent in participating in, or in playing, games has fascinated people since they realized survival was indeed a competition. This basic premise has evolved over time. In today's society, many every day common events, as well as very peculiar manufactured situations have formed the underlying basis for various games. This is demonstrated by the ever-growing popularity of television game shows, including reality-based game programs.

Historical records show that a board game which appeared similar to checkers was found in the ruins of the city of "Ur" (today's Iraq) and was dated to about 3000 B.C. As we know it today, the game of checkers dates back to 1400 B.C. Other popular board games such a Monopoly® and Scrabble® were brought to the public in the 20th century (1933 and 1948 respectively).

American society's fascination with board games resides, at least in part, on the fact that most successful board games seek to imitate human experience within a fantastic setting. The most commercially successful board games allow the player(s) to step outside of their every day lives into a fantasy world while playing the game. A similar principle controls the fascination of many people with sports, especially professional sports. Sport figures, such as American Football players and their accomplishments in the field, represent to many their own unfulfilled fantasies.

The immense popularity of American Football in the U.S. combined with well known and extensively documented game rules, make it an ideal sport to form the basis of a successful board game. Games that simulate various aspects of American Football are well known and have been disclosed numerous times. Today's technology has allowed a great proliferation of various forms of computerized American Football games playable in personal computers or hand-held devices. Those games, by requiring auxiliary electronics, screens, monitors, batteries, electrical hookups or other devices are not encompassed by this invention, which is concerned with a completely mechanical arrangement with simple magnetic components.

Gonzales U.S. Pat. No. 5,332,215, Charles U.S. Pat. No. 5,451,050, Godwin U.S. Pat. No. 4,173,346 and Conti U.S. Pat. No. 3,888,485 are rather limited examples of the type of American Football board game to which the present invention pertains. None of the examples found while reviewing the prior art involve construction toys.

Many construction toy-based inventions have been disclosed and marketed. The most common variety of construction toys comprises a plurality of brick elements having protrusions and recesses to allow connection with one another. Over the years, multiple variations of this theme have been disclosed. For example, U.S. Pat. No. 5,545,070 by Liu, discloses a construction toy set wherein once connected with each other, block elements can be turned relative to one another by swivel connectors. In another example of the development of construction toy technology, U.S. Pat. No. 6,086,444 by Glickman discloses a block-type construction toy wherein the protrusions and recesses are negatively tapered providing for a tactile sensible snap action which provides a secure assembly.

SUMMARY OF THE INVENTION

By being assembled substantially using construction bricks and figures that can be attached to construction bricks, and in light of its novel and useful features, as it is disclosed herein, the game of this invention opens up a vast array of doors to the user not available in the prior art. The game of this invention provides flexibility of play and settings, educational value, strategic possibilities and stimulation of cognitive and coordination skills far superior to any other game disclosed in the prior art.

In light of the inherent disadvantages and lack of flexibility in the known American Football board game apparatus of the prior art, the present invention provides a construction toy American Football board-type game in which the player uses a game board and accessories laid out with all the features one would find in a real American Football field. The construction toy bricks and pieces of this invention comprise figures representing the different teams, players, referees, spectators, cameramen, and various accessories typically found in a football field such as goal posts, balls, removable face masks, and the construction toy bricks and other components necessary to assemble an American Football stadium comprising bleachers, a sky box, a score box, a camera assembly and two goal posts. The player figures can be engaged to a construction toy base which in turn sits on the playing board. Alternative embodiments of the invention allow the user to use a limited portion of the game board to play simplified versions of the full game, such as a football throwing game or a football kicking game.

A prime objective of this invention is to provide a board American Football game arrangement in which construction toy bricks of numerous colors, shapes and sizes can be used to assemble a simulated football stadium to be placed adjacent to the emblazoned game board.

Another objective of this invention is to allow the user of the American Football game board of the invention to choose among several alternative game playing moves. A dice is used to determine the game parameters such as the alternate play opportunities and the extent to which the ball can be advanced. The game of this invention comprises a manual which provides the user with all the rules of the game involving player movement, running, kicking, scoring and time limits. The game of this invention also comprises a construction instruction booklet that shows all the different construction brick pieces, assembly instructions to engage the pieces to build an American Football stadium and accessories.

Another objective of this invention is to provide a construction toy American Football game with rules which are designed to approximate the rules of conventional American Football, within the particular game setting.

Another objective of this invention is to provide player figures that can be engaged to the playing field to form offensive and defensive lines. A player figure so designated being able to have a play football attached to it as illustrated herein below, to advance the play football across the playing field via a throwing means comprising a mechanically-actuated arm equipped with a mechanism that allows the user to pull the arm back, hold it in place and urge it in a direction and angle chosen by the user. Another player figure being able to kick the playing ball or to score "field goals" via a kicking means comprising a mechanically-actuated leg equipped with a mechanism that allows the user to pull the leg back, hold it in place and urge it in a direction and angle chosen by the user. The quarterback and kicker figure can be angled by changing the relative angles of the torso and legs to regulate the angle and distance of the throw or kick.

Still another objective of this invention is to provide a plurality of player figures designated as receivers and defenders which are fitted with receiving means in order to catch the playing ball being thrown by the throwing player figure or being kicked by the kicking or punting player figure. The receiving means can be incorporated into the receiver or defender player figures or can be a removable shoulder protection pack adapted to those figures.

Finally, an objective of this invention is to provide a playing ball equipped with means to attach itself to the receiving means. The ball's means to attach itself comprise a magnetic metal core of opposite polarity from the catching means, such magnetic metal core being covered with an appropriate magnetic conducting material.

The present invention resides not in any one of the specific structures and objectives set forth herein above per se, but rather in the combination of all of the invention's features for the functions specified. There are additional features of the inventions that will be specified hereinafter and/or illustrated by the drawings attached hereto. Those skilled in the art to which the invention pertains will appreciate the flexibility offered by the present invention in that the conception upon which this application is based, may be utilized as the foundation for designing and building other structures, arrangements, methods and systems for carrying out the multiple purposes of the present invention. It is therefore important that this disclosure be regarded as including such equivalent arrangements insofar as they do not depart from the scope and spirit of the invention as disclosed herein.

BRIEF DESCRIPTION OF THE VARIOUS VIEWS OF THE DRAWINGS

Figure 12:
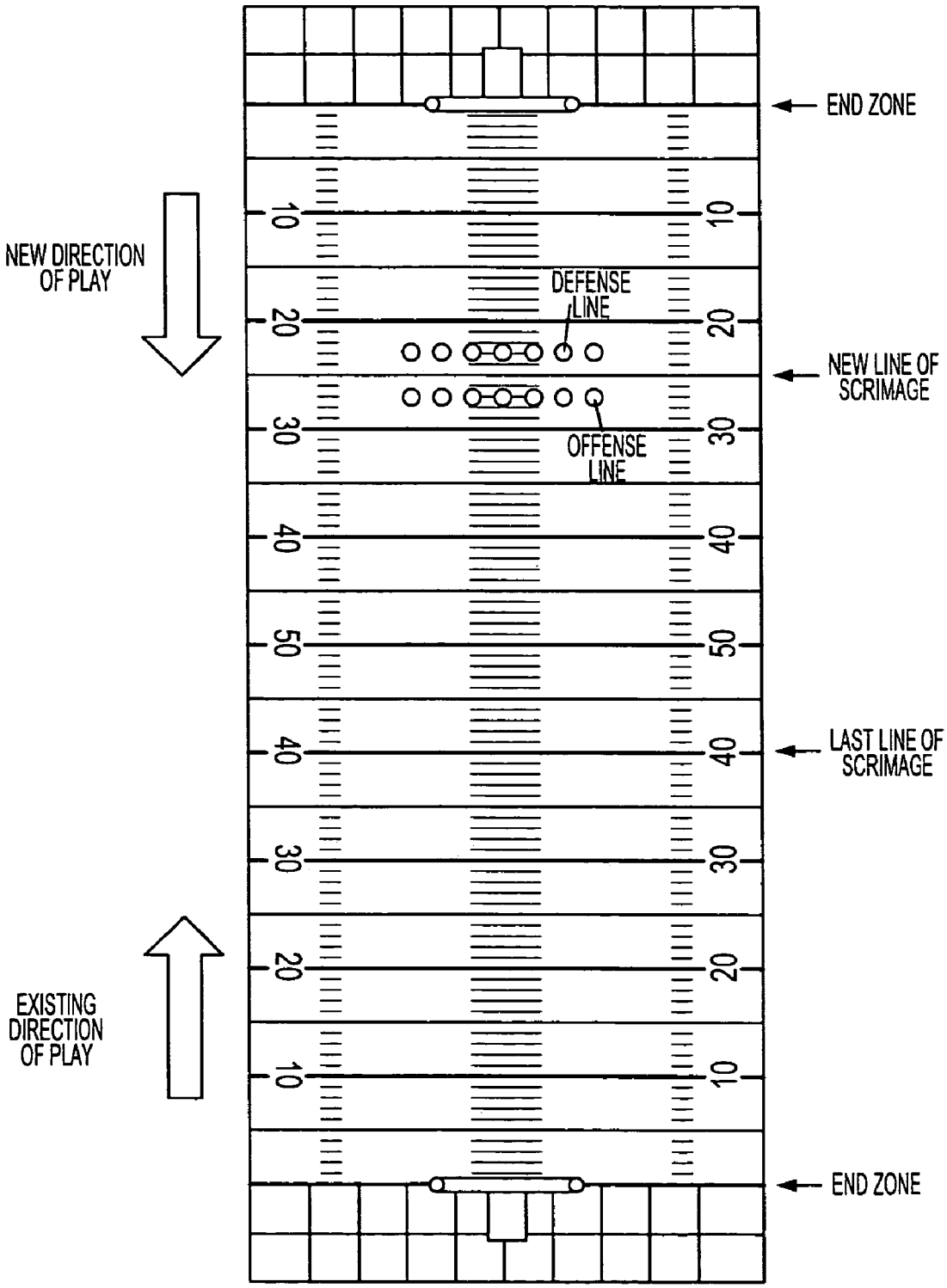

FIG. 12 further illustrates movement on the game field towards a user's end zone.

Figure 13:
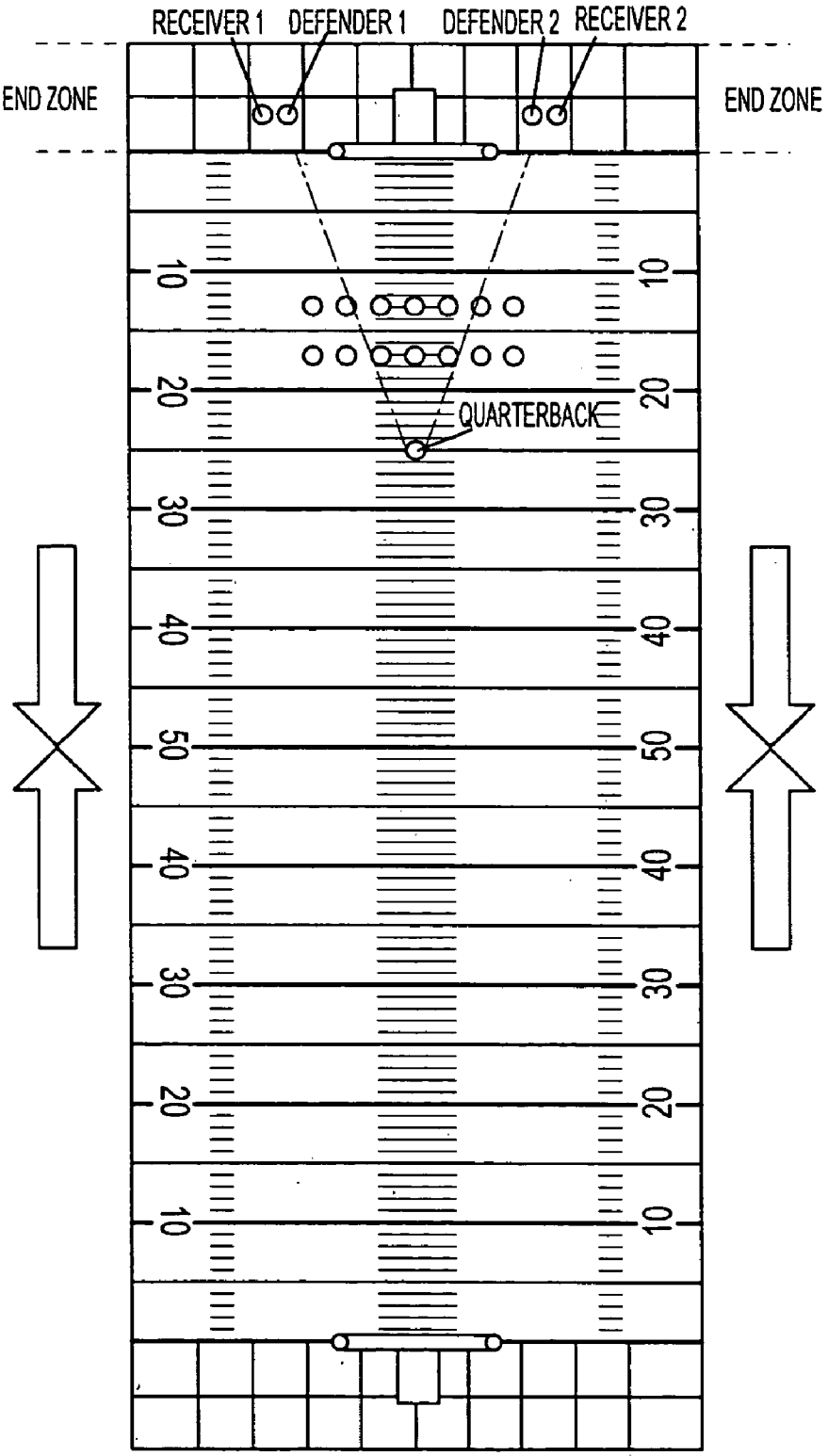

FIG. 13 depicts how touchdowns can be scored by the offensive user.

Figure 14:
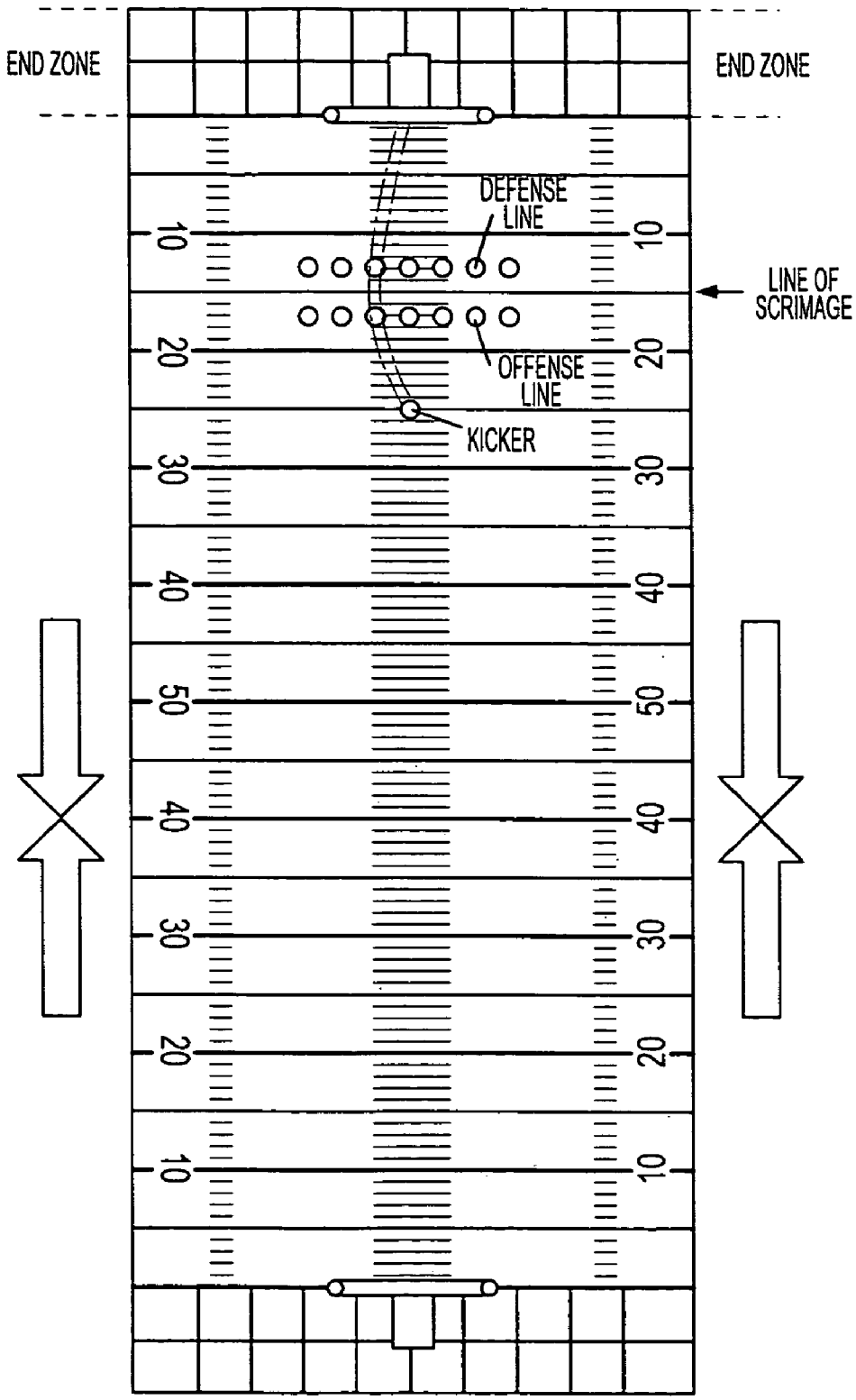

FIG. 14 shows the kicker figure attempting to kick a field goal.

DETAILED DESCRIPTION OF A PREFERRED EMBODIMENT

Figure 1:
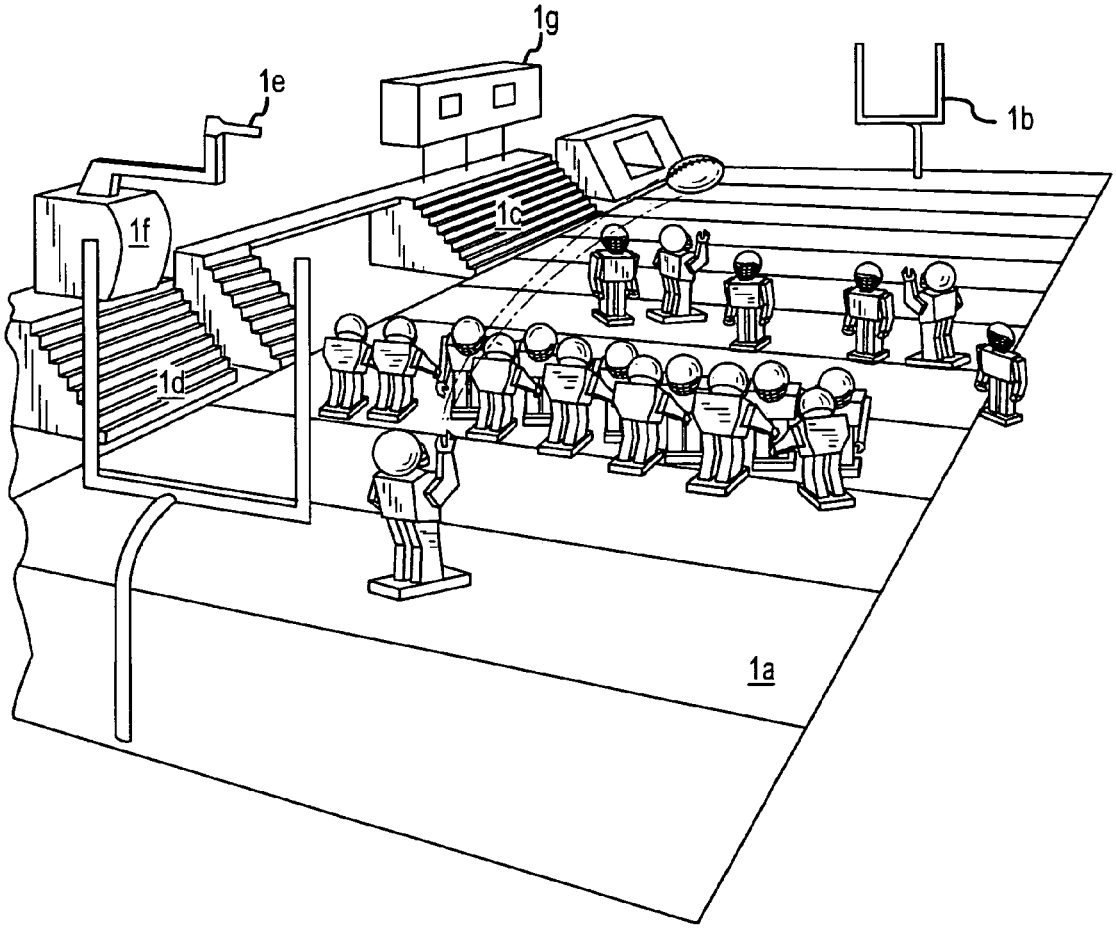
FIG. 1 depicts an American Football playing field, capable of receiving a stadium to be placed adjacently, goal posts, and various figures.

With reference now to the drawings, and initially to FIG. 1, the various physical components which make up the elements of the American Football game, assembled in accordance with the present invention are illustrated.

Primary to those elements is the game board 1, which as shown, comprises an American Football playing field game board 1*a* drawn or printed on a foldable cardboard or any other flexible surface. In its preferred illustrated form, the playing field comprises multicolor drawings with spaces to place a stadium, goal posts and multiple playing figures as game pieces as illustrated in FIG. 1, elements 1*b*, 1*c*, 1*d*, 1*e*, 1*f* and 1*g*.

Figure 2:
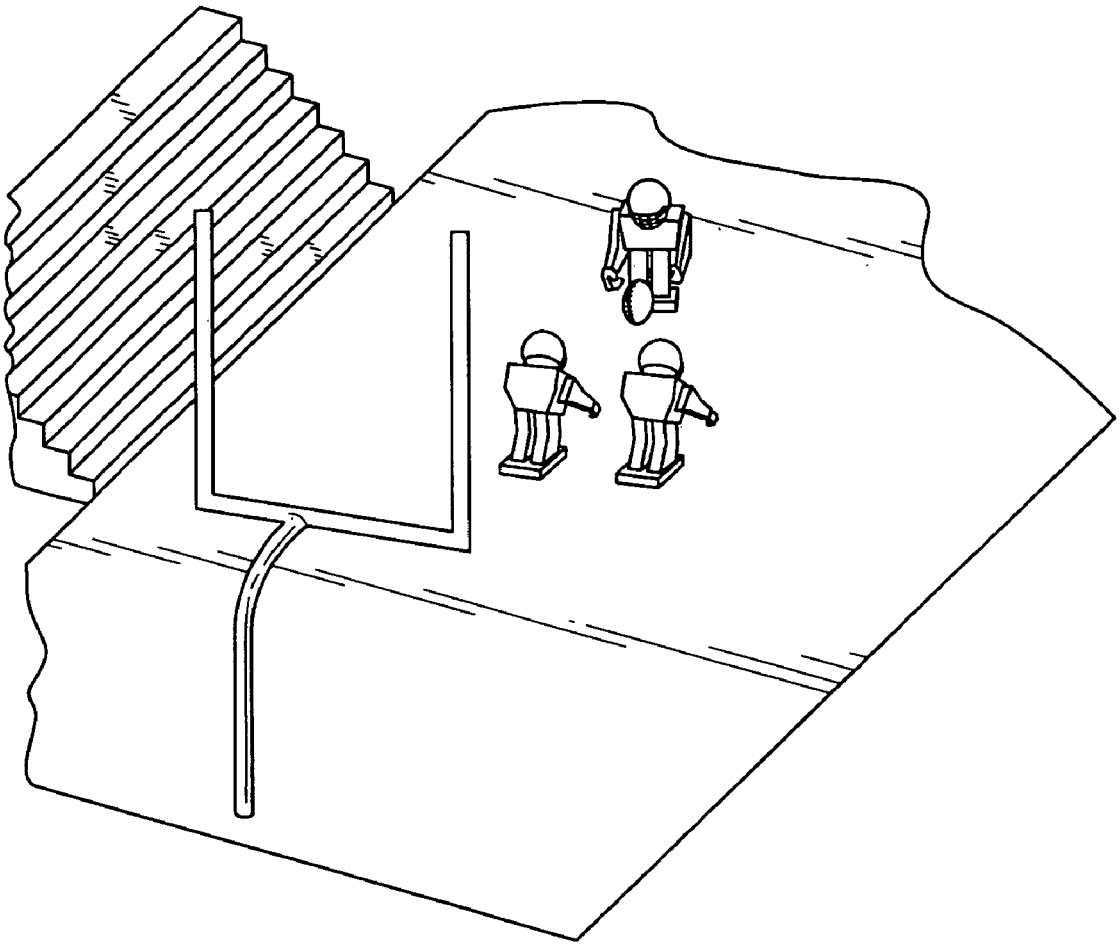
FIG. 2 and FIG. 3 illustrate at least two additional, more simplified games that can be played using a limited part of the playing field, namely a kicking game and a throwing game.
Figure 3:
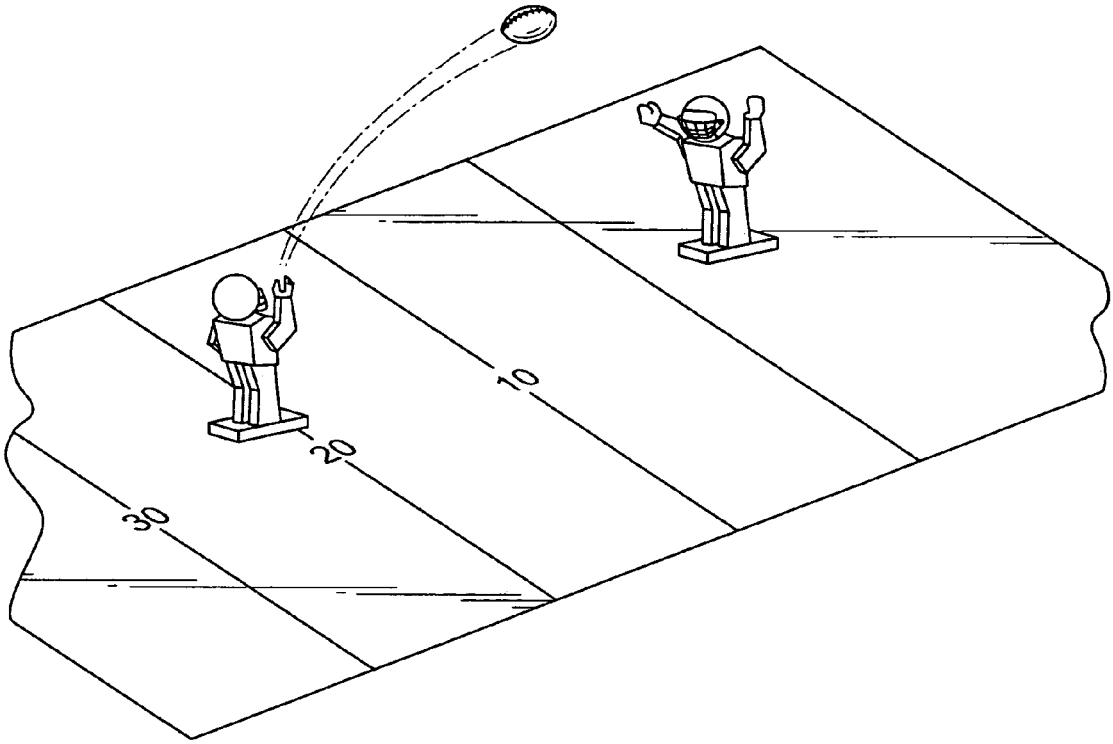
Figure 4A:
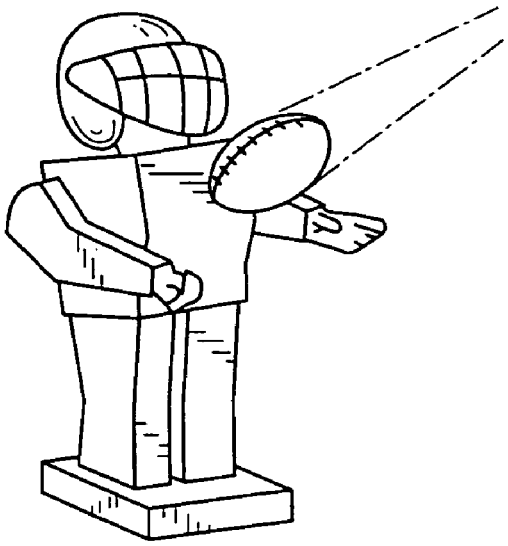
FIG. 4 shows the multiple figures, comprising miniature reproductions of uniformed referees and football players.
Figure 4B:
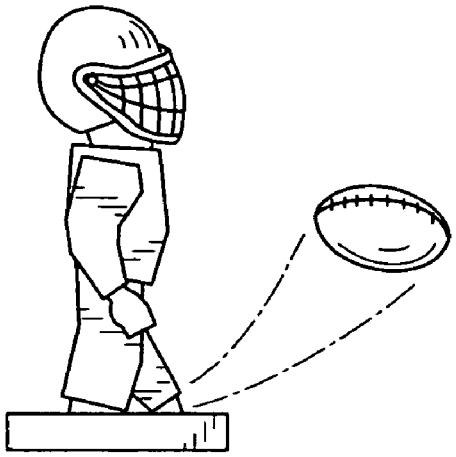
Figure 4C:
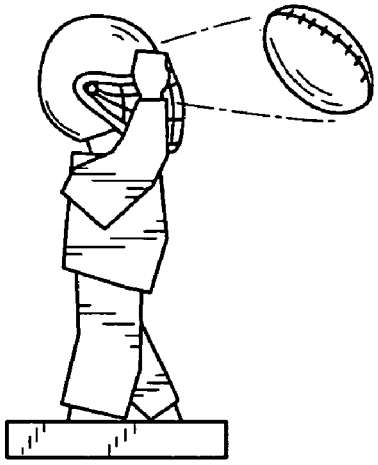
Figure 4D:
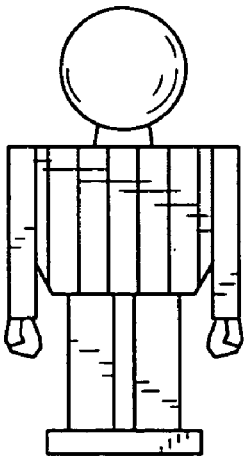
Figure 5A:
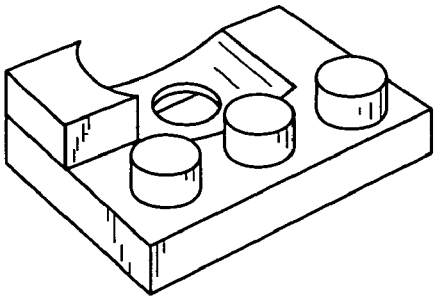
FIG. 5 illustrates various vital components of the game of the invention such as the kicking base (5*a*), the player figure's helmet (5*b*) with a removable face mask (5*c*), the goal post (5*d*) and the construction toy base (5*e*).
Figure 5B:
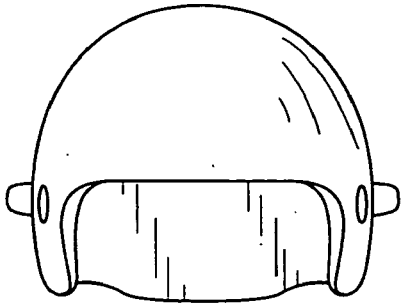
Figure 5C:
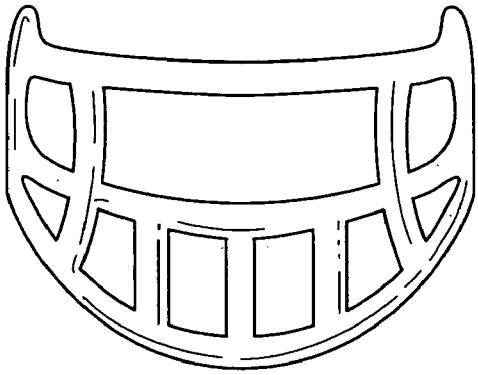
Figure 5D:
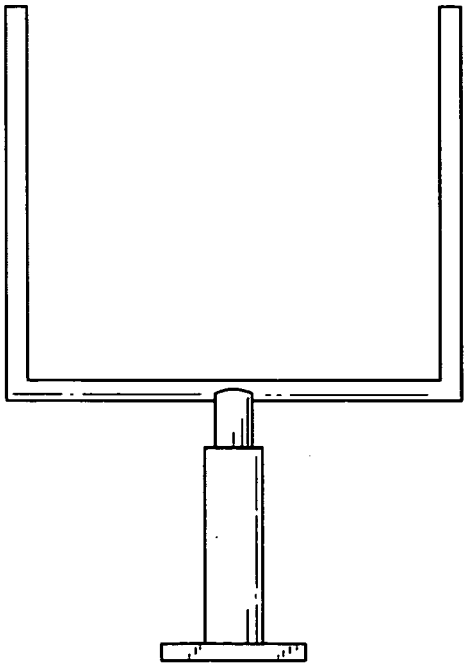
Figure 5E:
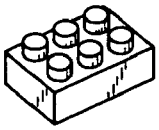

As shown in FIG. 2 and FIG. 3, at least two additional more simplified versions of the game using a limited portion of the field of play can be used for a kicking game and a throwing game.

As shown in FIG. 4, the multiple player figures comprise miniature reproductions of uniformed referees, and of football players selected from the group consisting of receivers 4*a*, kickers 4*b*, quarterback 4*c*, referee 4*d*, defenders and offensive linemen.

FIG. 5 illustrates various important components of the game of the invention such as the kicking base (5*a*) used by the kicker figure to place the football prior to kicking, the player figure's helmet (5*b*) with a removable face mask (5*c*), the goal post (5*d*) used to score field goals and the construction toy base (5*e*). As shown in FIG. 5, all figures are designed to engage on a construction toy base 5*e*. The referee and player figures can be placed on the game board's surface at various pre-determined places to accomplish the execution of a game play.

Figure 6:
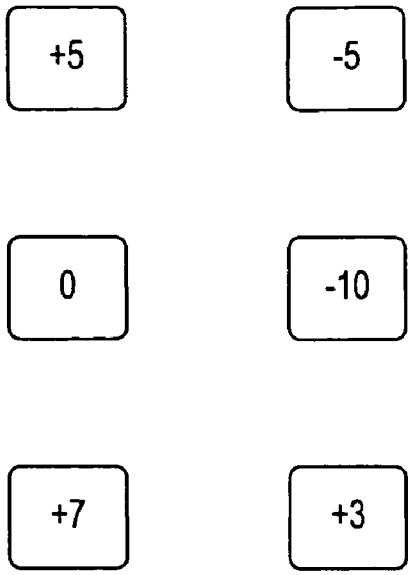
FIG. 6 depicts the dice used as part of the game.
Figure 7:
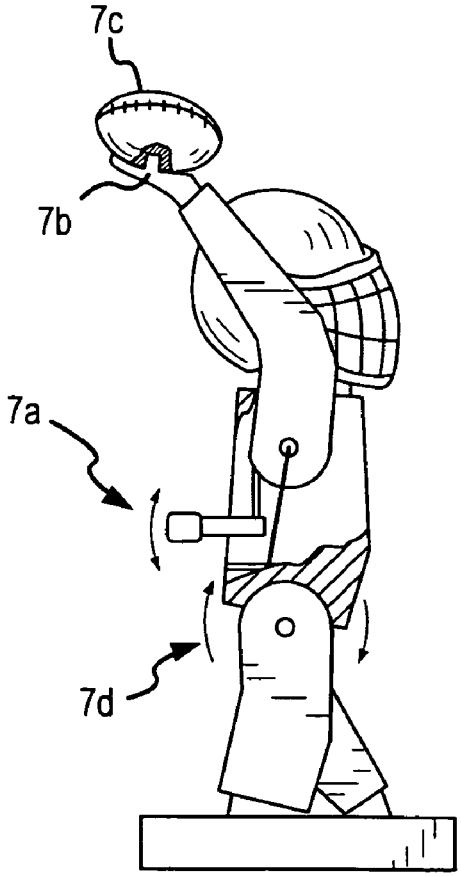
FIG. 7 shows an alternative embodiment for the quarterback figure throwing arm mechanism.
Figure 8:
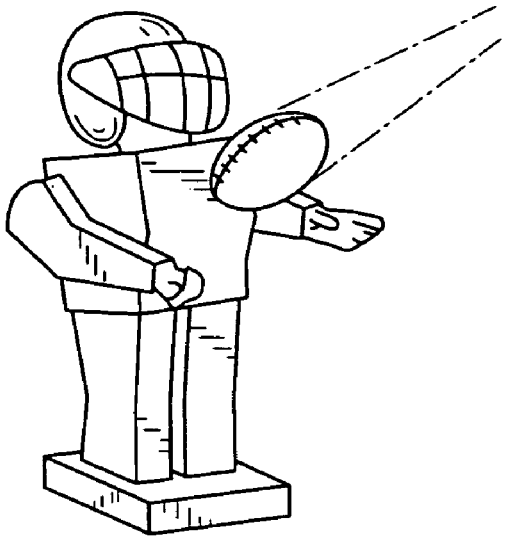
FIG. 8 illustrates how the receiver and defender figures can actually catch the playing ball being thrown or kicked by another figure and shows how the playing ball is able to attach itself to the defender or receiver figure through a receiving means.

FIG. 6 depicts the dice used to select which user plays first and to define the running plays. FIG. 7 shows the internal workings of one of the alternative embodiments used to allow the quarterback figure to propel its throwing arm forward while attempting to throw the football. FIG. 8 illustrates how the receiver and defender figures can actually catch the playing ball being thrown or kicked by another figure and shows how the playing ball is able to attach itself to the defender or receiver figure through a receiving means.

The playing board of the invention is complimented by the provision of upstanding goal posts 1*b*, and sufficient construction toy bricks and parts for the user to build an American Football Stadium comprising bleachers, 1*c*, spectator boxes with spectator FIG. 1*d*, a cameraman FIG. 1*e*, announcer's box 1*f*, and a score board 1*g*, with specifically designated places illustrated on the game board to receive those elements as shown in FIG. 6.

In order to make the game of the invention as realistic as possible, certain player figures are provided with mechanisms and tools which allow the game's user to reproduce the function that a football player in the specific playing position would perform. As illustrated in FIG. 7, the quarterback figure is provided with a throwing arm comprising a mechanically-actuated propelling means 7*a*. Propelling means 7*a* is placed inside the joint of the quarterback figure's throwing arm with its body. At the other extreme of the throwing arm, in place of a hand, the quarterback figure is provided with a connecting means 7*b* that allows engagement of a miniature football 7*c*, as also shown in FIG. 7. As further illustrated in FIG. 7, the connecting means is designed to leave a very small space between itself and the ball so that the game's user can use the quarterback figure to throw the ball with ease while holding the ball tightly in a non-throwing position. The angle and degree of elevation of the throw is controlled by modifying the relative position of the quarterback figure's body and legs as illustrated in FIG. 7 (7*d*), while holding the ball tightly in any non-throwing position.

As illustrated in FIG. 8, the receiver and defender figures are fitted with a receiving means which allows them to catch the miniature football being thrown by the quarterback figure or being kicked by the kicking or punting player figure. The receiving means can be built into the receiver and defender figures or can be a removable shoulder protection pack comprising a catching means which in the preferred embodiment of the invention is represented by a magnetic metal piece.

The playing ball of the invention is equipped with means to attach itself to the shoulder protection pack receiving means as illustrated in FIG. 8. The ball's means to attach itself comprises a magnetic metal core of opposite polarity from the catching means, such magnetic metal core being covered with a magnetic conducting material.

Figure 9:
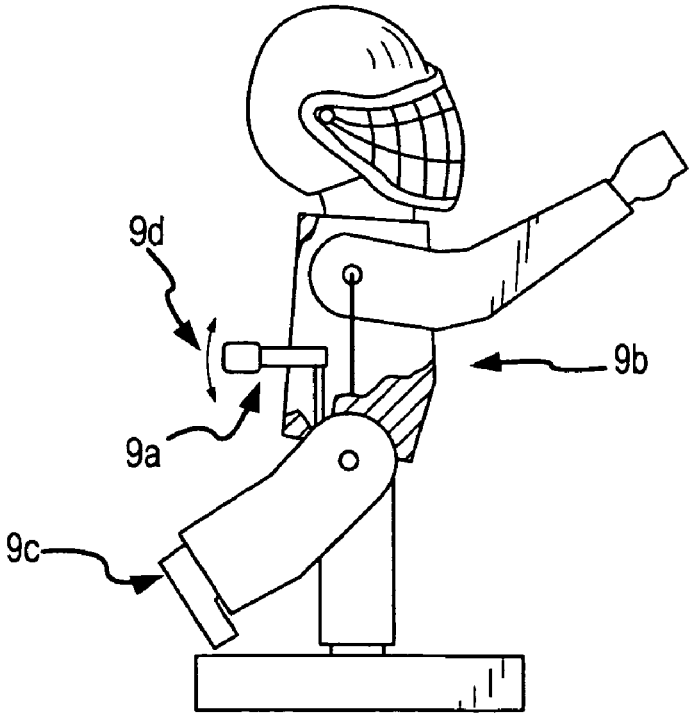
FIG. 9 illustrates how the kicker figure, by means of a kicking leg mechanism, can actually propel its leg forward.

As shown in FIG. 9, the kicker figure of this invention comprises a kicking leg mechanically engaged to propelling means 9*a*. In the preferred embodiment of the invention shown in FIG. 9, the propelling means is a spring roll mechanically and simultaneously engaged to the kicker's body 9*b* and to the kicker's leg 9*c*. The propelling means 9*a* allows the game's user to pull the kicking leg forward into any direction upon releasing a stop pin 9*d* by moving it from a "down" position to an "up" position.

The game of the invention is typically played between two teams. Each team must try to score the most points to win the game. Points can be gained in three different ways: (1) Scoring a touchdown which is achieved by having the receiver player catch the ball in the game board's end zone of the opponent's team to score 6 points; (2) Kicking a field goal which is achieved by having the kicker figure kick the ball between the opponent's goal post, passing over the lower bar to score 3 points; and (3) Kicking the ball (as in point 2) after scoring a touchdown (as in point 1) to score an extra 1 point.

The game can be played in two different ways. A user of the invention can play the game by the time method, which requires the user to set a time (e.g. 60 minutes) in which to play the game and have a time measuring device ready to time and check when the game is over. Using this method the winning team is the one with the most points after the agreed upon time is up. Alternatively, the user of the invention can use the point's method. Under this method, the users preset a number of points to score (e.g. 18). The team who gains that number of points first is the winner.

A typical kit of the game of the invention contains all the elements needed to play the football game in a very realistic manner. The elements in a typical game kit comprise: a game board, two quarterback figures; two kicker figures; multiple core-magnetized game balls; four receiver figures (used for offense and defense, equipped with magnetized removable shoulder packs); fourteen defense/offense figures (not equipped with magnetized shoulder packs); one dice for advancing the offensive running figures; one 10-yard marking device; building instructions for the construction of a football stadium; and construction toy bricks used to build the football stadium.

Figure 10:
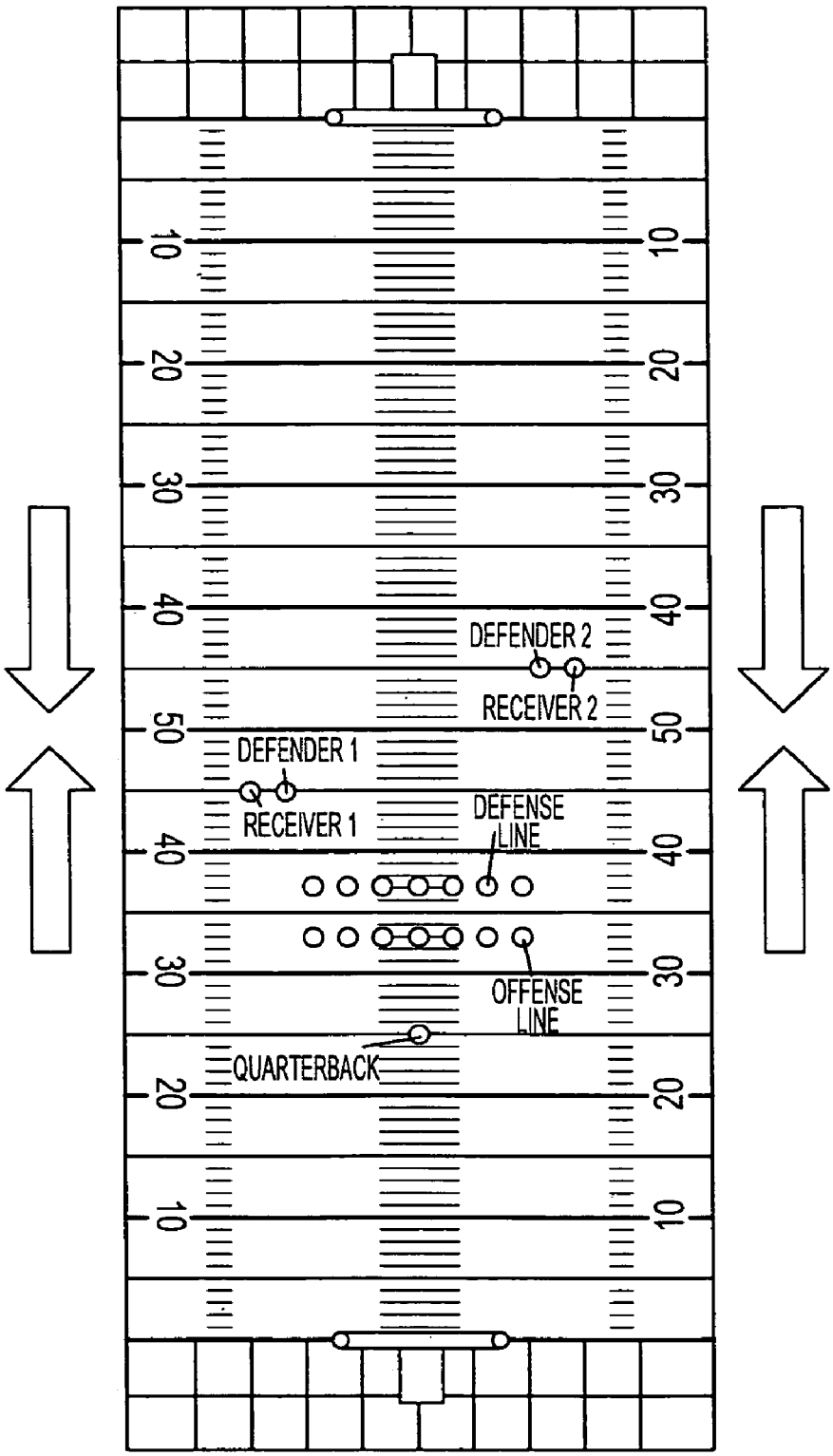
FIG. 10 illustrates how actual plays on the playing field can be executed between the offensive user and the defensive user.

The best way to grasp the unique and realistic characteristics of the present invention is to describe some typical plays in light of the rules of the game. The game can be played by two users or two teams of users. Play is initiated by rolling the dice. Each of the two users rolls the dice once. The user with the highest score plays first. The dice has positive and negative numbers. If both users roll a negative number then the highest negative number is the winner. For example "−5" wins over "−10". Any positive number always wins over a negative number. The user playing first will be playing on offense. The offensive user must line up its players across its own 35-yard line facing the opponent's goal. The offensive user must place its quarterback FIG. 10 yards behind the offensive line. At the same time the defensive user must line up its players facing the offensive line at the line of scrimmage as illustrated in FIG. 10.

The offensive user must decide whether it wants its quarterback to run, throw or kick a field goal, and it must announce to the other user what it wants to do. If the quarterback is to throw, then the offensive user can place its two receivers anywhere down field as shown in FIG. 10. When this is done the defensive user may place its defensive players (figure containing the magnetic core) at the side of or behind the receiver figures, but not in front of it as shown in FIG. 10.

Figure 11:
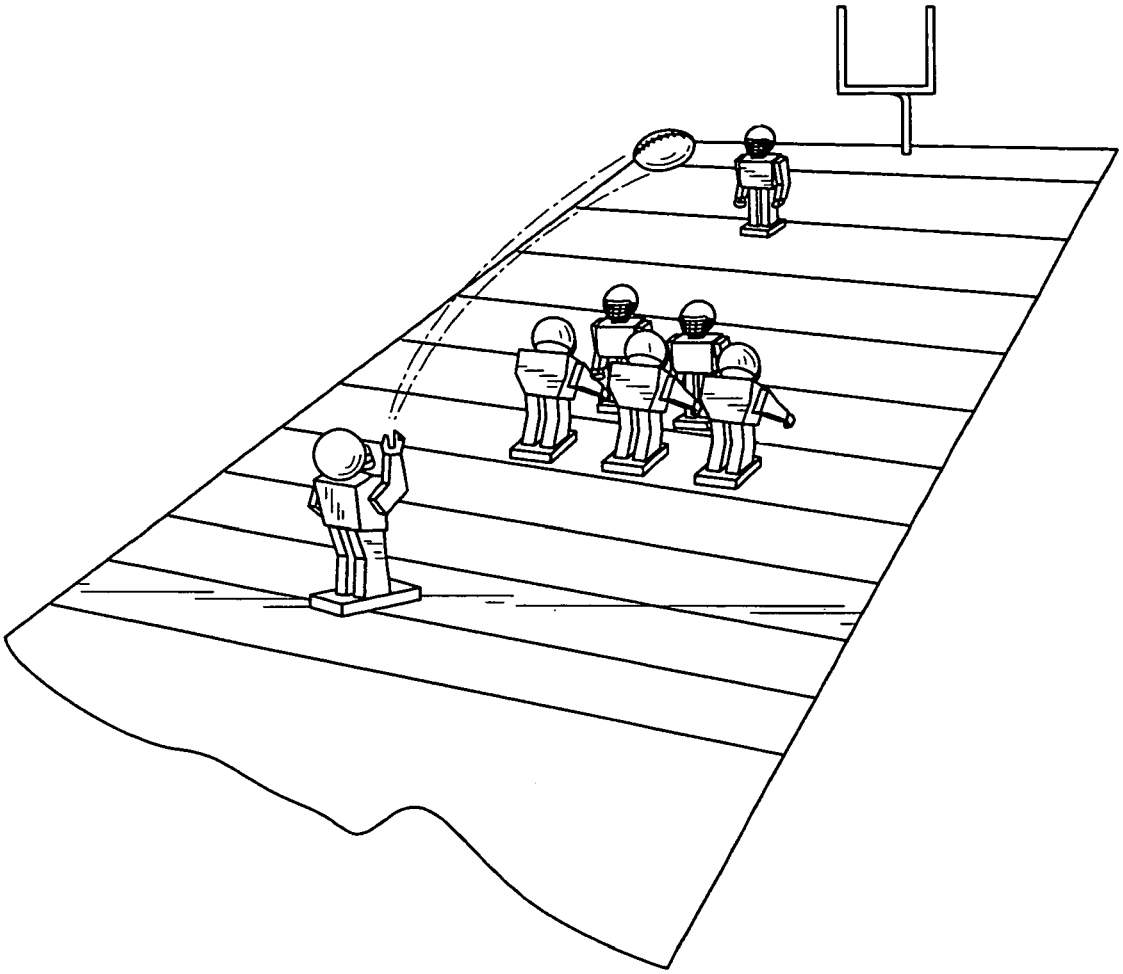
FIG. 11 shows the quarterback figure throwing the football.

In order to advance on the game board, the offensive user must then use the quarterback figure to throw the ball to one of the receiver figures as illustrated in FIG. 11. If the receiver figure "catches" the ball then the pass is complete and the offensive line and defensive line (or line of scrimmage) moves up to the point where the catch was made. A pass is caught if the result of the quarterback figure's throw is that the ball ends up attached to any part of the receiver figure's body. It does not matter whether the ball hits the game board or another figure first.

If the ball is not caught then the steps described above can be repeated up to a total of three times. In order to continue playing offense, the offensive user must cause the line of scrimmage to be moved forward at least 10 yards during the three attempts or downs. If it does not the defensive user takes over on offense, 35 yards towards its own goal from the last line of scrimmage. Subsequently, the now offensive user has all the options and is subject to all the rules described above for offense.

An interception takes place when a pass from the quarterback figure misses the receiver and is caught by a defensive figure. The user that was playing on defense when an interception took place automatically takes over possession of the ball and becomes the offensive team at the point of interception (new line of scrimmage). The user that was playing on offense becomes the defensive team.

If the offensive user decides that the quarterback figure will run instead of throwing, this is done by way of rolling the dice. The line of scrimmage moves in accordance with the number of yards shown on the dice (e.g. if the dice shows a "+10" the line moves 10 yards towards the defensive user's goal, but if the dice shows a "−5" the line moves 5 yards back towards the offensive user's own goal. If a "0" is rolled the line does not move at all. Each roll of the dice counts as one down.

Each time the line advances 10 yards in, then the offensive user automatically restarts with a fresh set of three available downs. FIG. 12 illustrates movement on the game field towards a user's end zone.

Touchdowns (worth 6 points) can be scored by the offensive user if its receiver figure catches the ball in the defensive user's end zone, as shown in FIG. 13. The offensive user also has the option of having the kicker figure kick a field goal at any time during one of the offensive user's three downs as also set forth in FIG. 14. If upon being kicked the ball passes between the two goal posts and over the lower bar, the offensive user gains 3 points. Following a field goal, the then defensive user takes over on offense at its own 35 yard line. If the offensive user misses the field goal the then defensive user takes over on offence at the point or line where the field goal was attempted which coincides with the position of the kicker.

The line of scrimmage is defined as an imaginary line between the offensive and defensive figures. The game of the invention is equipped with a yard marker which the users can place at the original line of scrimmage and should only be moved when 10 or more yards are gained within three downs. The new imaginary line between the offensive and defensive figures then becomes the new line of scrimmage where the game users should place the yard marker.

What is claimed is:

1. An apparatus for use by multiple players for playing a board type game which simulates the game of American Football comprising:

a. a game board having emblazoned on a rectangular, foldable surface a depiction of an American Football playing field, said depiction comprising opposed 50 yard sections, a goal line at one end of each said section, and an end zone section adjacent said goal line, and being further divided by yard stripes;

b. means defining a stadium zone to place a construction toy stadium, said stadium zone having a defined length, said stadium zone being disposed along a side of the playing field;

c. a plurality of figures representing miniature reproduction of American Football spectators, cameramen, uniformed referees, and players selected from the group consisting of receivers, defenders, kickers, quarterback, defensive lineman and offensive linemen, each figure having four movable limbs and a movable torso, and comprising a top end and a bottom end and at least one aperture in the bottom end, one half of the player figures being of one color, and the remaining half being of a contrasting color;

d. a receiving means placed in the receiver and the defender figures' torso, said receiving means being magnetized with sufficient polarity and magnetic strength to allow magnetic engagement of small magnetized objects to the receiver and defender figures;

e. a plurality of quadrilateral construction toy bases comprising a top side and a bottom side, the top side comprising a plurality of equidistant peg-like protrusions designed to accept the apertures in the bottom end of a figure so that at least one figure can be mechanically and firmly engaged to one base;

f. a plurality of quadrilateral construction toy kicking bases comprising a top side and a bottom side, the top side comprising a plurality of peg-like protrusions designed to accept the kicker figure and the football in a configuration that allows the game's user to use the kicker figure to propel the football forward;

g. a plurality of multidimensional construction toy bricks of multiple shapes comprising a top side and a bottom side, the top side comprising a plurality of equidistant peg-like protrusions and a bottom end comprising a plurality of equidistant apertures designed to accept the top end of another brick so multiple bricks can be mechanically and firmly engaged to one another to build structures simulating an American Football stadium, said protrusions designed to accept the aperture of a figures and the apertures of the construction base;

h. a plurality of upstanding goal posts bases each comprising a top end and a bottom end, said bottom end comprising a structure capable of being engaged to a construction toy brick, said top end comprising a lower bar and two endings connected to simulate the shape of an American Football goal post each ending capable of receiving at least two stacked extensions to form the shape of an American Football goal post;

i. a plurality of clear plastic quadrilateral pieces capable of mechanically engaging with one another and with a plurality of construction toy bricks of appropriate size and shape to form a miniature spectator box, said spectator box capable of mechanically engaging with the bottom side of the spectator figures;

j. a plurality of clear plastic quadrilateral pieces capable of mechanically engaging with one another and with a plurality of construction toy bricks of appropriate size and shape to form a miniature announcer's box, said announcer's box capable of engaging with the bottom side of the announcer figure and the bottom side of the cameraman figure through a cameraman's chair;

k. a miniature football, said football having an outer side and an inner side, said outer side encasing the inner side and comprising magnetic conducting material, said outer side having an aperture and said inner side containing a magnetic core;

l. means for arbitrarily selecting the order of play and a distance that an offensive player can be moved forward or backward in a running play;

m. a yard marking means which the game users can use to measure various plays of the invention;

n. optionally selectable means for providing alternate play opportunities;

o. means for timing plays and play periods in a manner similar to those of the game of American Football;

p. a construction instruction booklet showing a plurality of construction brick pieces and provides assembly instructions to engage the pieces to build a miniature American Football stadium;

q. a manual which provides the user with all the rules of the game involving player figure movement, running, kicking, scoring and time limits; and r. a plurality of adhesive numbers which can be placed on the player figures for identification purposes.

2. An apparatus for use by multiple users for playing a board type game which simulates the game of American Football according to claim 1 wherein the construction toy bricks can be engaged to one another to build miniature American Football stadium, said stadium comprising bleachers, a plurality of spectator boxes, an announcer's box and a score box.

3. An apparatus for use by multiple users for playing a board type game which simulates the game of American Football according to claim 1 wherein the player figures are provided with mechanisms allowing a board game's user to reproduce the specific function that an American Football player in a specific playing position would perform.

4. An apparatus for use by multiple users for playing a board type game which simulates the game of American Football according to claim 1 wherein the quarterback figure comprises a body and a throwing arm, said body further comprising a torso and legs and means to change the relative position of said torso and legs, said throwing arm comprising a shoulder side and a band side, said throwing arm being mechanically and flexibly engaged to the body of the quarterback figure by an arm joint placed in the shoulder side, said quarterback figure comprising a mechanically-actuated propelling means placed at the joint so that the quarterback figure's throwing arm can be mechanically pulled back, held in place and subsequently urged forward toward any direction chosen by the game's user, the user being able to control the distance and angle of the quarterback figure's throw by modifying the relative position of the torso and legs.

5. An apparatus for use by multiple users for playing a board type game which simulates the game of American Football according to claim 1 wherein the hand side of the quarterback figure's throwing arm comprises a connecting means that allows engagement of the outer side of football, so that the quarterback figure can propel the football in a direction chosen by the game's user upon the game's user mechanically pulling back the propelling arm, allowing the propelling arm to be held in place and subsequently urging said arm forward, said connecting means being designed to leave sufficient space between itself and the ball so that the quarterback figure can be used to throw the ball with ease and at certain angles and degrees of elevation controlled by the relative position of the torso and legs while holding the ball tightly in any non-throwing position.

6. An apparatus for use by multiple users for playing a board type game which simulates the game of American Football according to claim 1 wherein the receiver figure is capable of catching the football on the magnetized receiving means upon the quarterback figure throwing the football, or the kicker figure kicking the football.

7. A apparatus for use by multiple users for playing a board type game which simulates the game of American Football according to claim 1 wherein the kicker figure comprises a body and a kicking leg, said body further comprising a torso a stationary leg and a kicking leg and means to modify the relative positions of said torso and said legs, said kicking leg comprising a hip side and a foot side, said kicking leg being mechanically and flexibly engaged to the body of the kicker figure by a leg joint placed in the hip side, said kicker figure comprising a mechanically-actuated propelling means placed at the leg joint so that the kicker figure's kicking leg can be mechanically pulled back, held in place and subsequently can be urged forward toward any direction chosen by the game's user.

8. An apparatus for use by multiple users for playing a board type game which simulates the game of American Football according to claim 1 wherein the kicker figure can advance the football forward by placing the kicker figure on the kicking base, placing the football in front of the kicker figure's kicking leg and by mechanically pulling back the kicking leg, holding it in place and subsequently urging said leg forward and allowing it to make contact with the football, the angle and distance of the football's movement being controlled by modifying the relative positions of the torso and the legs.

9. An apparatus for use by multiple users for playing a board type game which simulates the game of American Football according to claim 1 wherein the means for arbitrarily selecting the order of play and the distance that an offensive figure can be moved forward or backward in a running play comprises a dice bearing the numbers −10, −5, 0, +3, +5 and +7.

* * * * *